US006858256B2

(12) United States Patent
Zeiffer

(10) Patent No.: US 6,858,256 B2
(45) Date of Patent: Feb. 22, 2005

(54) APPARATUS FOR APPLYING FOAMED COATING MATERIAL TO A TRAVELING TEXTILE SUBSTRATE

(75) Inventor: Dieter F. Zeiffer, Iron Station, NC (US)

(73) Assignee: Gaston Systems, Inc., Stanley, NC (US)

( * ) Notice: Subject to any disclaimer, the term of this patent is extended or adjusted under 35 U.S.C. 154(b) by 226 days.

(21) Appl. No.: 10/122,247

(22) Filed: Apr. 11, 2002

(65) Prior Publication Data

US 2002/0108568 A1 Aug. 15, 2002

Related U.S. Application Data

(62) Division of application No. 09/343,644, filed on Jun. 30, 1999, now Pat. No. 6,395,088.

(51) Int. Cl.[7] ..... B05D 3/12
(52) U.S. Cl. ..... 427/345; 427/176
(58) Field of Search ..... 427/345; 118/302; 101/425

(56) References Cited

U.S. PATENT DOCUMENTS

| | | | |
|---|---|---|---|
| 2,114,618 | A | 4/1938 | Wallin |
| 2,992,627 | A | 7/1961 | Ring |
| 3,042,573 | A | 7/1962 | Roberts |
| 3,832,427 | A | 8/1974 | Muich |
| 3,969,780 | A | 7/1976 | Henderson |
| 4,016,831 | A | 4/1977 | James et al. |
| 4,023,526 | A | 5/1977 | Ashmus et al. |
| 4,061,001 | A | 12/1977 | von der Eltz et al. |
| 4,062,989 | A | 12/1977 | Long |
| 4,064,891 | A | 12/1977 | Eberhardt |
| 4,072,775 | A | 2/1978 | James et al. |
| 4,089,296 | A | 5/1978 | Barchi |
| 4,159,355 | A | 6/1979 | Milnes et al. |
| 4,225,638 | A | 9/1980 | Waugh |
| 4,237,818 | A | 12/1980 | Clifford et al. |
| 4,239,821 | A | 12/1980 | McLean et al. |

(List continued on next page.)

*Primary Examiner*—Brian K. Talbot
(74) *Attorney, Agent, or Firm*—Kennedy Covington Lobdell & Hickman, LLP

(57) ABSTRACT

A coater for applying foamed coating material to a traveling textile substrate including a frame, a flush pan, an applicator having an open slot, a pivot shaft journaled in a pair of support arms that are pivotally mounted to the frame and piston-cylinder mechanisms to move the applicator between an operating position wherein the open slot is adjacent the traveling substrate and a flush position wherein the open slot is adjacent the flush pan by pivoting the support arms and rotating the pivot shaft. Foamed coating material is applied by supporting the traveling substrate between two spaced support elements, contacting the traveling substrate with a foam applicator, and forcing a metered amount of foamed material at least partially into the interstices of the textile substrate before the foamed coating material collapses. A metered amount of foamed coating material is applied onto or into a textile substrate regardless of textile substrate structure and regardless of the viscosity of the coating material. The foamed coating material may be flushed from the coater by stopping flow of foamed material through the applicator, moving the applicator to the flush position, and commencing flow of a flushing fluid through the applicator and into the flush pan. Foamed coating material may also be flushed from the applicator by stopping flow of foamed material through the applicator, commencing flow of a flushing foam through the applicator, stopping flow of flushing foam through the applicator, and commencing flow of a flushing fluid through the applicator.

8 Claims, 10 Drawing Sheets

U.S. PATENT DOCUMENTS 4,292,918 A 10/1981 Davis et al.
4,297,860 A 11/1981 Pacifici et al.
4,299,591 A 11/1981 Gregorian et al.
4,305,169 A 12/1981 Vidalis
4,326,904 A 4/1982 Eckert et al.
4,343,835 A 8/1982 Jones et al.
4,349,930 A 9/1982 Van Wersch et al.
4,357,373 A 11/1982 Cooper
4,364,784 A 12/1982 Van Wersch et al.
4,384,867 A 5/1983 Grüber
4,387,118 A 6/1983 Shelton
4,394,289 A 7/1983 Brown et al.
4,398,665 A 8/1983 Bryant et al.
4,402,200 A 9/1983 Clifford et al.
4,407,767 A 10/1983 Seaborn
4,408,995 A 10/1983 Guth et al.
4,420,510 A 12/1983 Kunkel et al.
4,431,429 A 2/1984 Booth
4,442,144 A 4/1984 Pipkin
4,444,104 A 4/1984 Mitter
4,463,467 A 8/1984 Grüber et al.
4,463,583 A 8/1984 Krüger et al.
4,473,521 A 9/1984 Tassone
4,485,508 A 12/1984 Otting
4,490,428 A 12/1984 Long
4,500,039 A 2/1985 Pacifici et al.
4,501,771 A 2/1985 Long
4,502,304 A 3/1985 Hopkins
4,512,279 A 4/1985 Damrau et al.
4,521,362 A 6/1985 Tassone
4,528,214 A 7/1985 Long et al.
4,548,611 A 10/1985 Paterson et al.
4,548,837 A 10/1985 Yoshino et al.
4,557,218 A 12/1985 Sievers
4,562,097 A * 12/1985 Walter et al. ..... 427/209
4,565,715 A 1/1986 Long
4,569,107 A 2/1986 Pomeroy
4,576,112 A 3/1986 Funger et al.
4,581,254 A 4/1986 Cunningham et al.
4,582,660 A 4/1986 Tassone
4,622,243 A 11/1986 Long
4,624,213 A 11/1986 Long et al.
4,624,813 A 11/1986 Long
4,637,940 A 1/1987 Long
4,641,404 A 2/1987 Seydel et al.
4,644,900 A 2/1987 Poterala
4,655,056 A 4/1987 Zeiffer
4,656,063 A 4/1987 Long et al.
4,661,399 A 4/1987 Anderson, Jr. et al.
4,711,792 A 12/1987 Long
4,741,924 A 5/1988 Long et al.
4,753,823 A 6/1988 Long
4,769,260 A 9/1988 Long
4,773,110 A 9/1988 Hopkins
4,792,252 A 12/1988 Kremer et al.
4,796,558 A 1/1989 Chartrand et al.
4,844,001 A 7/1989 Jones
4,943,451 A 7/1990 Zimmer
4,944,078 A 7/1990 Nakade
4,970,039 A 11/1990 Long
5,008,131 A 4/1991 Bakhshi
5,009,932 A 4/1991 Klett et al.
5,066,428 A 11/1991 Manlowe et al.
5,074,883 A 12/1991 Wang
5,089,296 A 2/1992 Bafford et al.
5,145,527 A * 9/1992 Clifford et al. ..... 118/411
5,165,261 A 11/1992 Cho
5,202,077 A 4/1993 Marco et al.
5,219,620 A 6/1993 Potter et al.
5,277,041 A 1/1994 Ahrweiler et al.
5,340,609 A 8/1994 Arthur et al.
5,367,982 A * 11/1994 DeMoore et al. ..... 118/46
5,403,622 A 4/1995 Nishi et al.
5,409,733 A 4/1995 Boger et al.
5,418,009 A 5/1995 Raterman et al.
5,429,840 A 7/1995 Raterman et al.
5,484,453 A 1/1996 Baehr et al.
5,505,995 A 4/1996 Leonard
5,524,828 A * 6/1996 Raterman et al. ..... 239/413
5,525,373 A 6/1996 Chandler
5,556,471 A * 9/1996 Boccagno et al. ..... 118/300
5,657,520 A 8/1997 Greenway et al.
5,683,508 A * 11/1997 Bleiler et al. ..... 118/46
5,887,519 A 3/1999 Zelko

* cited by examiner

APPARATUS FOR APPLYING FOAMED COATING MATERIAL TO A TRAVELING TEXTILE SUBSTRATE

CROSS-REFERENCES TO RELATED APPLICATIONS

The present application is a divisional U.S. patent application claiming priority under 35 U.S.C. § 120 from allowed U.S. patent application Ser. No.: 09/343,644, filed Jun. 30, 1999, now U.S. Pat. No. 6,395,088, issued May 28, 2002 herein incorporated by reference.

BACKGROUND OF THE INVENTION

1. Technical Field

This invention relates generally to the field of textile coating machines and more particularly to an apparatus and method for applying a foamed coating to a traveling textile substrate.

2. Background Information

The processing of textile fabrics and similar substrates typically involves application of various coating materials to the fabric to achieve specific purposes. For example, binder coatings are used on some textile substrates to improve the structural integrity of the substrate and dye coatings are often used on textile substrates to achieve a desired fabric color. Regardless of the particular coating being applied, two important and often competing considerations must be addressed. First, it is important that the required amount of coating material be uniformly applied to the textile substrate. Failure to uniformly apply sufficient coating material to the substrate could result in such deficiencies as insufficient structural integrity of the textile substrate in the case of binder coating processes or inconsistent or variable coloration in the case of a dye coating process. Second, coating material must be efficiently applied. Using more coating material than required is wasteful and therefore costly and applying coating materials in an inefficient manner, such as spraying, can result in environmental pollution and necessitate costly measures to reduce the environmental impact of the coating process.

Applying a uniform coating to a textile substrate in an efficient manner is particularly difficult when the coating material is a material such as latex or any other material that is film-forming at atmospheric pressure. These coating materials typically have higher viscosities than many textile coating materials and can also dry inside coating machinery and thereby clog or reduce the flow in that machinery. When coating with film-forming coating materials, therefore, precautions must be taken when the substrate line stops or when a coating process is completed. The coating apparatus must be sufficiently cleansed of the film-forming material after operation or the machinery must be left in such a condition that the coating material is not allowed to dry on the inside walls of the applicating machinery. This is particularly important in the area of the applicator nozzle, which is sized to ensure that a specific amount of material is applied. Any film buildup on the walls of the applicator nozzle can either clog the nozzle or result in delivery of less than the designed amount of coating material.

There are several known methods of applying coatings to a textile substrate. One such method is immersing a moving substrate in a bath of coating material. This method usually applies more coating material than required to the traveling substrate and thus it is often necessary for the substrate to undergo subsequent processes, such as nip rolls or dryers, to remove excess coating material and moisture. This immersion method, therefore, is inefficient because too much coating material is applied to the substrate and wasteful because some coating material is lost in the subsequent process of removing the excess material.

Another known method of coating a textile substrate is to apply coating material to the surface of a traveling substrate and allow the coating material to impregnate the substrate by absorption or by capillary action. But absorption and capillary action can result in nonuniform application of coating material, especially when using viscous coating materials such as latex because the effectiveness of these methods depends in large part upon the structure or composition of the substrate. A non-uniform substrate often results in non-uniform absorption or capillary coating. Moreover, relying upon absorption or capillary action also results in more coating material being applied to the surface of the substrate than required to ensure that enough coating material is available for penetration into the fabric. The excess coating materials must then be removed from the fabric using devices such as a doctor blade or knife edge.

In recognition of the limitations of capillary action coating, various additional coating techniques have been developed. For example, one variation involves the application of vacuum to the substrate in order to draw coating material deposited on one surface into the substrate. Another variation involves directing the coated substrate through a series of nip rolls to force coating material into the substrate. While these variations are perhaps more efficient than solely coating a textile fabric, they can also produce such undesirable results as the lack of uniform distribution of coating material and waste of coating material.

A number of attempts have been made to overcome the drawbacks of the above-mentioned coating processes and many of these attempts involve the use of foamed coating materials. Foamed coating methods are advantageous because they allow the delivery of coating material to a substrate using less water than non-foamed coating procedures. This results in less runoff waste liquids—which require proper disposal precautions—and less energy use because subsequent machinery to remove excess water from fabrics is eliminated using foam coating techniques.

But even foamed coating material have disadvantages. For example, it is often difficult to achieve uniform application of foamed coating material to a substrate because the results of conventional foamed coating methods often vary depending on the structure of the textile substrate or the viscosity of the coating material.

Another problem with conventional foamed coating methods is how to accommodate disruptions or stoppages in the textile processing line. This difficulty results from the fact that foamed material breaks down over time and becomes nonuniform if pressure is ever allowed to equalize in the distribution path. When processing of a textile substrate is halted, as would be required to accommodate machine stoppages upstream or downstream of a traveling textile substrate, to correct substrate breakage, or to change substrate materials, then either the foam applicator must be shut—thereby risking equalizing pressure in the foam distribution system—or foam flow can be continued—thereby wasting coating materials and wasting that portion of the traveling substrate upon which the excess coating material accumulates during the line stoppage.

Complicating the problem even further is the fact that many textile mills process fabric face-down. This procedure allows workers clear visibility of the processes occurring to the back side of the fabric but face-down processing of textile fabrics is problematic for coating machines dispensing film-forming coating material because when the fabric line stops or is shut down there is the risk that the film-forming coating will dry in the applicator nozzle or on the inner surface of the coating delivery piping. If the coating material is a foamed film-forming material, the problem is worse still because there is the added difficulty of not allowing the foamed material to equalize pressure throughout the distribution line. Furthermore, when operations are completed, it is essential that the film-forming coating material be properly cleansed from the applicator components, which are necessarily facing downward in order to apply the coating to the reverse side of a face-down fabric as it travels along the processing line.

It would therefore be desirable for a coating apparatus to have the capability to uniformly dispense a foamed film-forming coating material along the width of a traveling face-down substrate while at the same time having the ability to accommodate temporary line stoppages as well as long-term production line halts without resulting in nozzle clogging or coating material buildup on the inside of the coater walls. This capability would desirably be independent of the structure of the substrate and independent of the coating material used. It would also be desirable for such a machine to be easily cleansable without necessitating time-consuming disassembly and/or manual part cleaning.

There are numerous designs of foam applicators existing in the art, several of which are capable of delivering a foamed coating of film-forming material. But these applicators have not achieved all of the desirable characteristics of a coating apparatus discussed above. For example, U.S. Pat. No. 4,562,097 to Walter et al. discloses a method of treating a porous substrate by applying a foamed treating composition on the surface of the substrate with an applicator nozzle in contact with the moving substrate. While latex is disclosed as a suitable treating composition, the Walter et al. patent does not appear to specifically address the inherent film-forming problem associated with latex application or a method of cleansing such a film-forming material from the applicator when not in use.

U.S. Pat. No. 4,023,526 to Ashmus et al. discloses foam applicator heads for the application of a chemical treatment. Uniformity of foam application in this device, however is effected by the angle and contact between the substrate and the inward taper of the downstream nozzle lip. Also, as in the previously discussed patent, the Ashmus patent does not specifically address the problem of film formation during line stoppages or the problems incurred when using the disclosed applicator head in a fabric line to treat fabric face-down.

U.S. Pat. No. 5,219,620 to Potter et al. discloses a foam applicator intended for use in a fabric line that processes fabric face-down. The Potter et al. foam applicator is an arcuate assembly that is pressed tightly against the traveling fabric by pneumatic or hydraulic cylinders over a wrap angle in order to assure uniform pressure and seal of the applicator against the fabric. Such an apparatus would therefore be undesirable for use in applying a film-forming material to a traveling textile substrate that could not withstand applicator pressure without breaking the substrate. Moreover, this patent does not appear to include latex or other film-forming compositions among the intended treating compositions and thus it too does not address the unique problem associated with such compounds.

While each of the patents discussed above describe an apparatus having certain desirable features, it is clear that a better foam coater is needed in the art. More particularly, there is a need for a foam coater apparatus capable of uniformly applying a metered amount of foamed, film-forming coating material to a traveling substrate in a face-down production line regardless of the structure of substrate and regardless of the viscosity of the coating material. The need is also for such a coater to have the ability to accommodate temporary line stoppages without wasting a significant amount of coating material when the line production recommences and to accommodate long-term line stoppages without allowing film formation to clog the applicator nozzle or associated foam delivery system piping. Finally, such a coater should have the ability to be cleansed of foamed material in an efficient and simple manner. Indeed, a coater possessing all of these attributes would be able to efficiently deliver a specified amount of film-forming coating material to a traveling substrate without wasting significant amounts of coating material and, when no longer needed, such a machine would be able to stop operations without the risk of film formation clogging the applicator nozzle.

BRIEF SUMMARY OF THE INVENTION

The present invention overcomes the drawbacks associated with conventional foam applicators by providing a coater having a foam applicator capable of delivering a metered amount of viscous foamed coating material to a traveling substrate regardless of the structure of the substrate. The applicator of the present invention is moveable between an operating position adjacent a traveling substrate and a flush position adjacent a flush pan. In its operating position, the applicator uniformly delivers a predetermined metered amount of foamed material to a traveling substrate in contact with an open slot of the applicator. Pressure and blow ratio of the foamed coating material are controlled to ensure that the desired amount of coating material is uniformly applied in a way that coating material penetrates at least partially into the interstices of the fabric before the foamed material collapses. The coater of the present invention can be used to deliver different foamed coating compositions; however, it is particularly suited to delivering film-forming coating compositions having a high viscosity, such as latex, because of the coater's ability to accommodate both temporary and long-term line stoppages without allowing significant foam pressure equalization or film formation and associated applicator clogging.

The coater of the present invention accommodates temporary line stoppages by providing a valve assembly in the applicator. The valve assembly has an applicator flow valve member for stopping foam flow to the traveling substrate and a bypass flow valve member for diverting foam flow to a bypass passage that allows foamed coating material to continue moving in the foam delivery system without being applied to the substrate. A foam recirculation path may be established in which foamed material exiting the applicator via the bypass passage is directed by a foam recirculation pump to the foam generator foamer head and then back to the applicator. During such foam recirculation, the supply of fresh coating material and air to the foam generator is stopped. When the line recommences operation, the applicator flow valve member preventing foam flow to the applicator slot is opened and the bypass flow valve member is shut, thereby restoring foam flow to the traveling substrate. When long-term production stops are required, the coater of the present invention may be easily repositioned to a flush position in which the open slot is adjacent a flush pan. In this position, foamed material may be completely flushed from the applicator system into the flush pan.

The coater of the present invention may comprise an applicator defining an open slot and attached to a pivot shaft that is journaled between a pair of support arms. A first operating piston-cylinder mechanism operably connected between the pivot shaft and one of the support arms can be used to pivot the applicator between an operating position in which the open slot is facing generally downward, below horizontal, and adjacent a traveling substrate and a predetermined intermediate position in which the open slot is facing generally above the horizontal, or upward. A second operating piston-cylinder mechanism operably connected between the coater frame and one of the support arms may be used to move the applicator from the intermediate position to a flush position in which the open slot is adjacent a flush pan. The second operating piston-cylinder mechanism may also be used when the applicator is in the operating position to tilt the applicator and thereby provide clearance between the applicator and the flush pan while the applicator is moving between the operating and intermediate positions.

Advantageously, the applicator of the present invention can be operated while facing downward to accommodate textile production lines having downward-facing traveling fabrics and then the applicator can be flushed while facing generally upward. This upward orientation allows flushing fluid to remain in the applicator after flushing has been completed, thereby preventing film formation on the walls of the applicator by insuring that the walls never dry out.

Using the coater of the present invention, a foamed coating material may be applied to a traveling substrate by supporting the traveling substrate in a linear run between two spaced support elements positioned on one side of the substrate. A foam applicator in communication with a foam generating source is then placed in contact with the traveling substrate between the two spaced support elements and on the opposite side of the traveling substrate from the support elements. The blow ratio and the system operating pressure are then selected to ensure that the foamed material is made to flow from the foam generator through the applicator and onto the traveling substrate such that the foamed coating material penetrates at least partially, and preferably only partially, into the interstices of the traveling substrate before the foamed material collapses.

The present invention also provides a method of flushing a foam coater apparatus wherein a flushing foam is first introduced into the coater and then high velocity flushing fluid is used. This method has been found to flush foamed material from a coater more completely than using only a straight water flush because the flushing foam, having a density more similar to the density of the foamed coating material than the density of the flushing fluid, is more effective in flushing the foamed coating material from the applicator. The use of a flushing foam prevents problems associated with conventional water flushing, such as ineffective foam flushing due to the channeling of the flushing fluid in the foamed coating material within the pipes of the applicator. After flushing the applicator with a flushing foam, a high-velocity water flush may advantageously be conducted.

Using the coater of the present invention, it is therefore possible to obtain the advantages of using foamed coating materials without the disadvantages commonly associated with film-forming materials. The coater of a present invention delivers uniformly a predetermined metered amount of foamed material to a traveling substrate regardless of the substrate structure and regardless of the coating material viscosity. Temporary production stops are no longer a problem because foam flow is maintained in the distribution system and bypassed around the substrate. Recommencing operation is easily achieved by again directing the foamed material through the open slot in the applicator and closing the bypass passage. When coating operations are complete, the coater of the present invention can be easily moved to a flush position and completely cleansed using flushing foam following by a flushing fluid, such as water. The applicator can be left substantially full of flushing fluid in order to prevent film formation along the walls of the applicator before the next coater use. These and other advantages of the present invention will become apparent upon reading the following detailed description and appended claims, and upon reference to the accompanying drawings.

BRIEF DESCRIPTION OF THE DRAWINGS

For a more complete understanding of this invention reference should now be had to the embodiments illustrated in greater detail in the accompanying drawings and described below. In the drawings, which are not necessarily to scale.

DETAILED DESCRIPTION OF THE INVENTION

The present invention will now be described fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. It will be understood that all alternatives, modifications, and equivalents are intended be included within the spirit and scope of the invention as defined by the appended claims.

Figure 1:
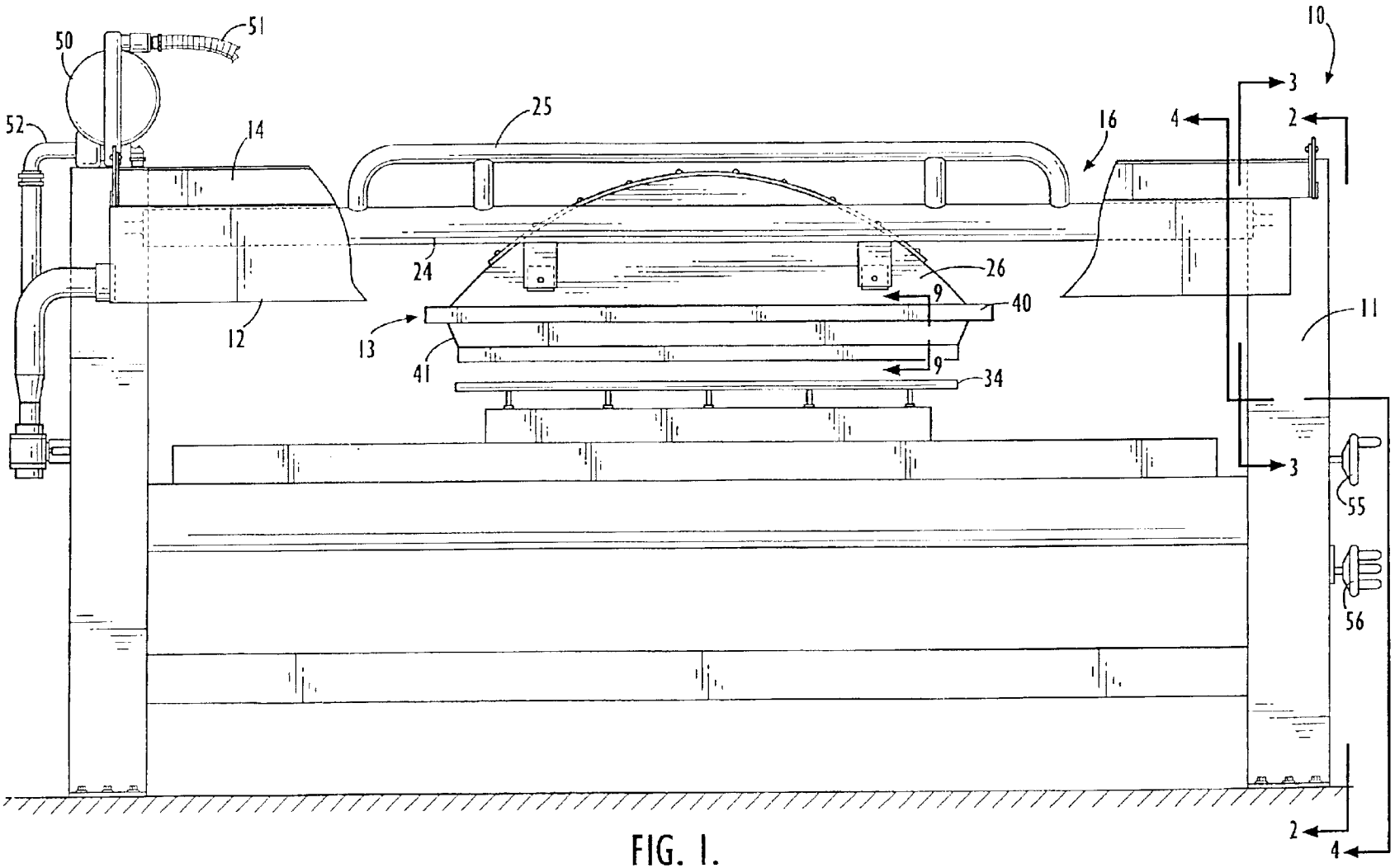
FIG. 1 is an elevational view of the preferred embodiment of the coater of the present invention with the flush pan partially cut away.

Turning now to FIG. 1, there is shown a coater 10 for applying foamed material to a traveling textile substrate. The coater 10 comprises a frame 11, a flush pan 12 (which is partially cut away in FIG. 1), an applicator 13, and a positioning mechanism 16 moveably mounting the applicator 13 onto the frame 11. The positioning mechanism 16 includes a pivot shaft 24 having a counterbalance 25. The applicator 13 includes a parabolic distribution chamber 26, an applicator valve assembly 40, and a replaceable nozzle 41 defining an open slot 27 (FIGS. 9 and 10) through which foamed material exits the applicator. A suitable parabolic distribution chamber for use in the present invention is disclosed in U.S. Pat. No. 4,655,056 to Zeiffer, the disclosure of which is hereby specifically incorporated by reference into the present application. The coater 10 also includes a flush pump 50.

The coater of the present invention may be advantageously utilized in textile processes in which a textile fabric is conveyed on a tenter frame, which may be adjustable to accommodate different fabric widths. The coater 10 is placed at a desired location in the textile process and positioned such that the traveling textile substrate travels between the applicator 13 and a pair of spaced support elements or rods 34. While FIG. 1 depicts an open space between the applicator 13 and the support rods 34, it should be understood that in operation the support rods 34 urge the traveling substrate into contact with the applicator 13 and more specifically into contact with the open slot 27 in the applicator 13, as shown more clearly in FIG. 5. Because the traveling substrate effectively closes or seals the open slot in the applicator, the present invention can utilize pressure to meter the foamed material from the applicator onto or into the traveling substrate such that the foamed material penetrates at least partially, and preferably only partially, into the interstices of the traveling substrate fabric before the foamed material collapses. Forcing coating material deeper into the substrate interstices than required for a specific coating application wastes coating material and is therefore advantageously avoided. Also, it will be understood by those in the art that, depending on the structure of the substrate, the present invention can be used to apply foamed coating materials that when dry will be entirely within the interstices of the substrate. To accommodate traveling substrates of different widths, the applicator 13 may be configured with replaceable nozzles 41 having different widths.

FIG. 1 also depicts the coater 10 in an operating position wherein the applicator 13 is in a vertical position with the open slot facing generally downward, or below horizontal. The ability of a coater to operate in this condition is advantageous because many textile processes are conducted on a substrate that is traveling face-down. Thus, the present invention allows for the uniform distribution of foamed material to the back of a textile fabric traveling face-down. This coating apparatus and method is particularly advantageous for use in applying latexes, polyurethanes, acrylics, and other high viscosity coating materials. For example, a typical foamed coating material that may advantageously be used with the coater of the present invention is composed of B.F. Goodrich Hystretch V-29 or Hycar 26-0370 emulsions. It should be understood, however, that the present invention is not specifically limited to use with such materials as the coater 10 may also be advantageously used to deliver foamed materials including, but not limited to, dyes, softeners, and fabric protectors.

Figure 2:
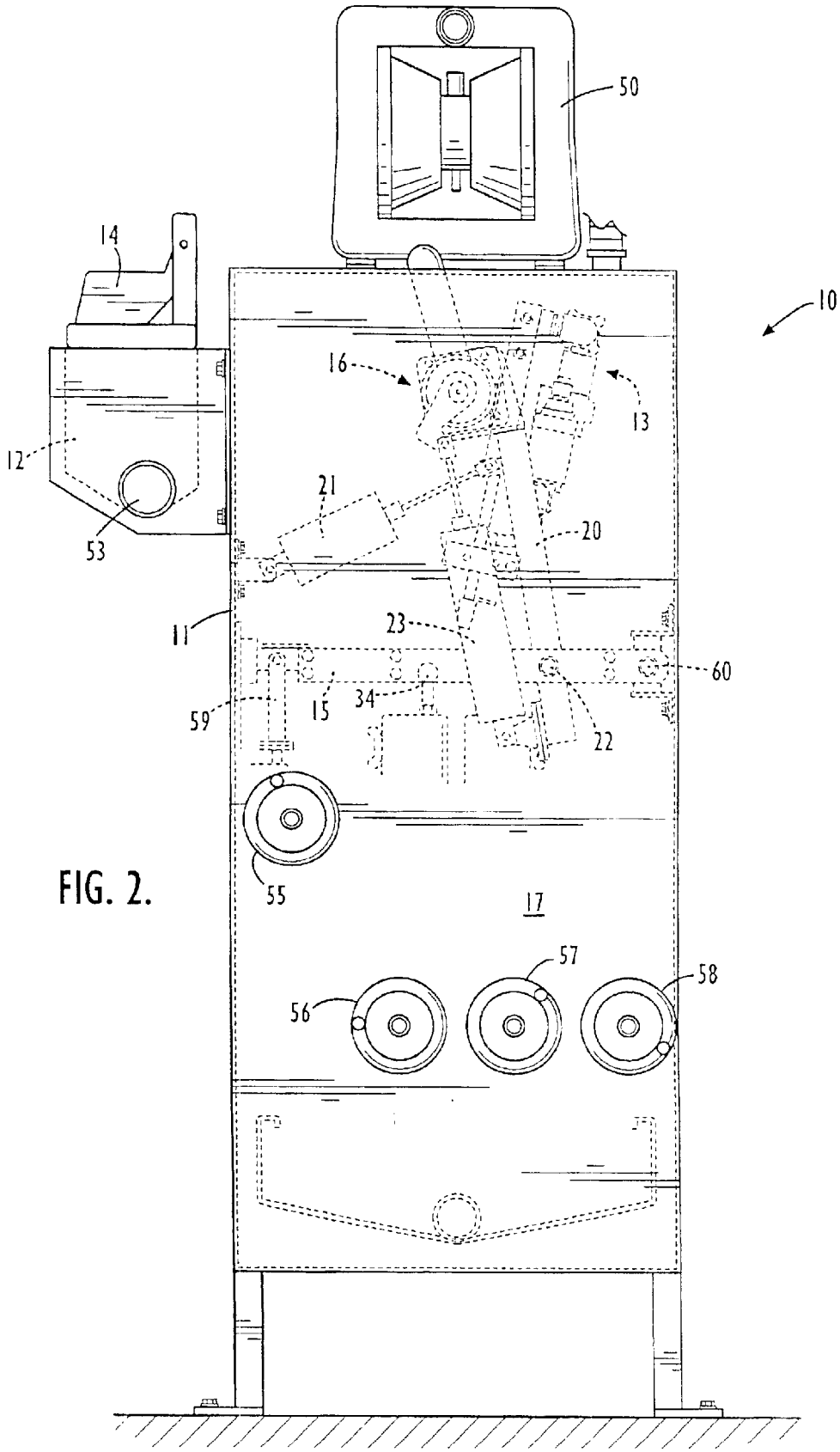
FIG. 2 is a side elevational view of the coater taken along line 2—2 in FIG. 1 with the operating mechanism and applicator shown in hidden lines behind a side cover plate and the applicator shown in the tilt position.

FIG. 2 shows a side view of the coater 10 of the present invention, including the flush pump 50 and flush pan 12, which includes a cover 14 and a flush pan discharge outlet 53. In FIG. 2, the positioning mechanism 16 and the applicator 13 are shown in dotted lines hidden by a side protective plate 17.

The coater of the present invention can be adjusted to accommodate its placement in existing textile processing facilities. For example, the applicator level can be adjusted within a predetermined range of applicator levels by using a level adjustment hand wheel 55 that is operably connected to horizontal frame members 15 on each side of the coater by linkages 59. This applicator level adjustment is advantageous because it allows the coater to accommodate processes wherein the traveling substrate is at a different height above the ground. Rotation of the hand wheel 55 causes the linkages 59 to raise or lower, which in turn pivots the horizontal frame members 15 about pivots for the horizontal frame members 60. Because the applicator is operably connected to the horizontal frame members, pivoting motion of the horizontal frame members changes the level of the applicator.

Hand wheel mechanisms are also used in the present invention to adjust the position of the support rods 34, which extend transversely across the traveling substrate. A leading support rod adjustment hand wheel 56 is operably connected to the leading support rod 34 such that rotation of the leading support rod adjustment hand wheel 56 changes the level of the leading support rod 34. Trailing support rod hand wheels 57, 58 are used to independently adjust the level of each side of the trailing support rod. By having two trailing support rod adjustment hand wheels, one end of the trailing support rod may be adjusted to a different level than the other end of the trailing support rod to thereby establish a tilt angle of the traveling substrate relative to the applicator.

As used herein, the leading support rod is the first support rod contacted by the traveling substrate as it enters the coater and the trailing support rod is the last support rod contacted by the traveling substrate before leaving the coater. For clarity, the leading support rod is labeled with reference number 34*a* on FIG. 4 and the trailing support rod is labeled with reference number 34*b* on FIG. 4. Also, the term "tilt angle" is used herein to describe the transverse angle of the traveling substrate as it travels over a support rod, measured relative to a hypothetical horizontal plane touching the open slot of the applicator. It should also be understood that, if desired, each side of the leading support rod could be independently adjustable to establish a tilt angle of the entering substrate.

The ability of the coater to accommodate different applicator levels, different support rod levels, and to impart a tilt angle to a traveling textile substrate allows the coater of the present invention a great deal of flexibility for use in a variety of existing textile processing applications.

Figure 3:
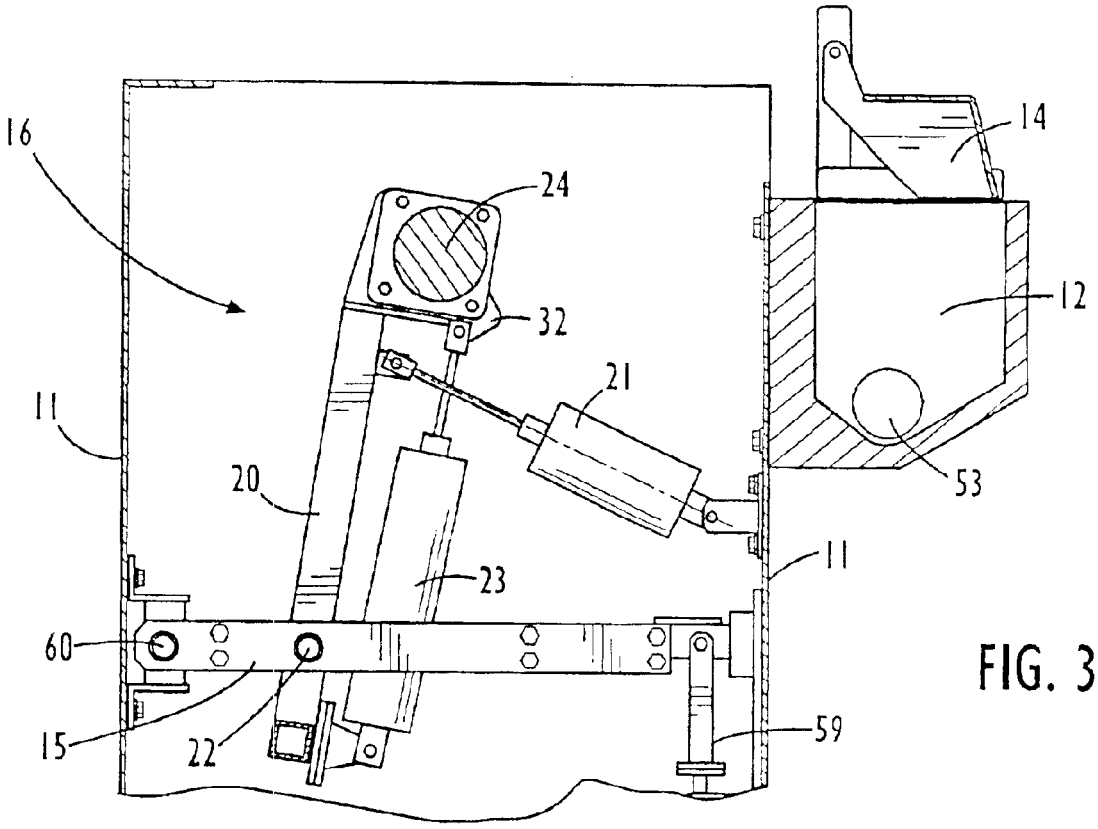
FIG. 3 is a partial vertical sectional view of the coater taken along line 3—3 in FIG. 1 showing the applicator in the tilt position.

A variety of different positioning mechanisms may be used with the coater of the present invention to move the applicator between its operating and flush positions. One suitable positioning mechanism is illustrated in FIG. 3. The positioning mechanism 16 includes a pair of support arms 20, a first pair of piston-cylinder mechanisms 23, and a second pair of piston-cylinder mechanisms 21. The support arms 20 are pivotally mounted to the frame 11 and specifically to the horizontal frame members 15. The first piston-cylinder mechanisms 23 are mounted on the support arms 20 and operably connected to the applicator such that operation of the first piston-cylinder mechanisms 23 causes the applicator to move relative to the support arms 20. The second operating piston-cylinder mechanisms 21 are mounted on the frame 11 and operably connected to the support arms 20 such that operation of the second piston-cylinder mechanisms 21 causes the support arms 20 to pivot.

While the positioning mechanism 16 illustrated in the present application utilizes piston-cylinder mechanisms, which may be pneumatically or hydraulically operated, it will be readily understood by those in the art that other such mechanisms may be used. For example, it is possible to use an electric motor driving a threaded extendable connecting rod, an electric motor driving a sprocket and chain mechanism, magnetic positioning mechanisms, or the like to accomplish the same functions as the operating piston-cylinder mechanisms. These other such methods are included within the scope of the present invention. Also, while FIG. 3 illustrates the positioning mechanism at one side of the coater 10, an identical mechanism is located at the other side with the two mechanisms operating simultaneously, although only one positioning mechanism may be used if desired.

Figure 4:
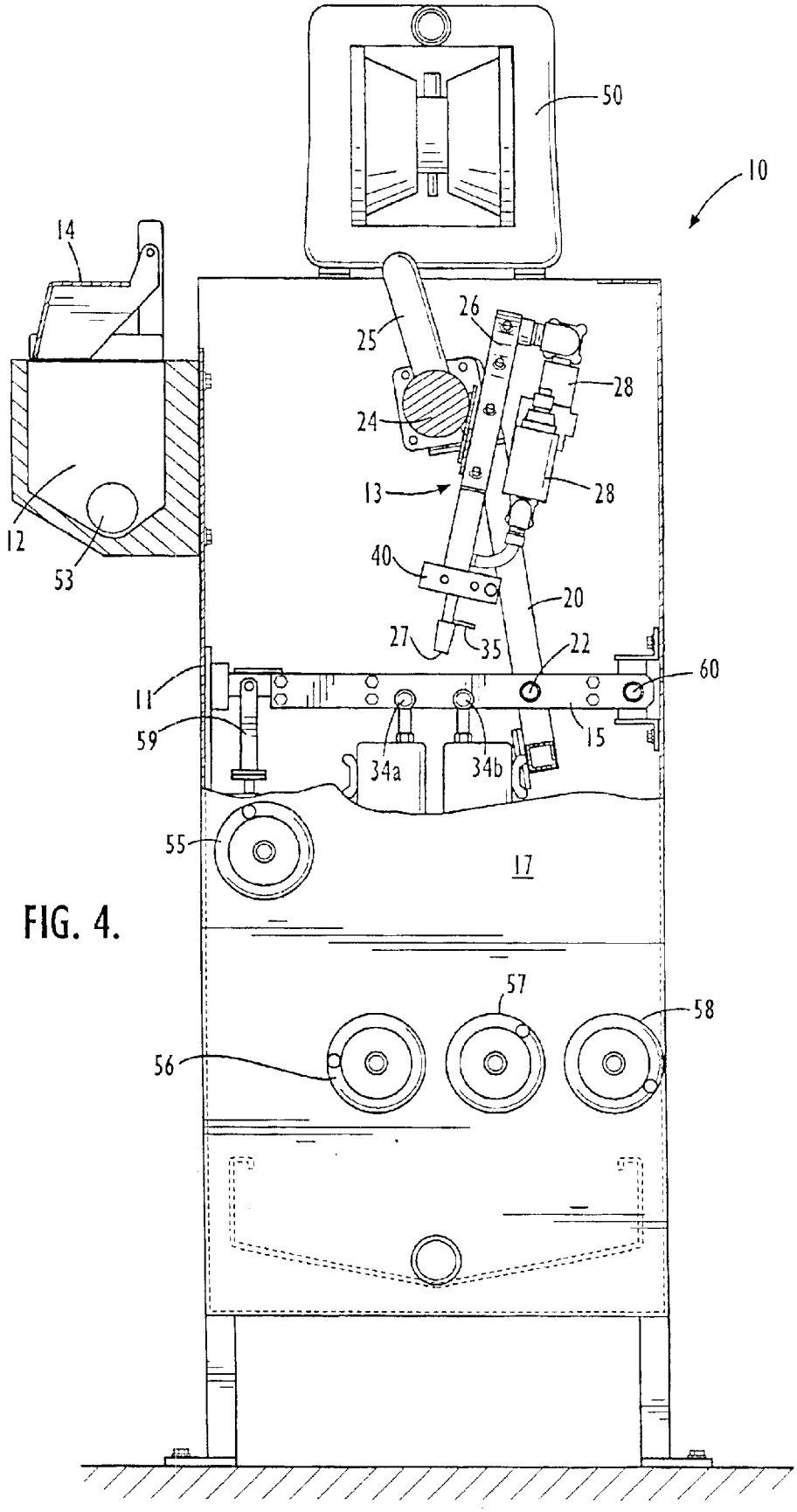
FIG. 4 is a side elevational view, partially in section, of the coater taken along line 4—4 in FIG. 1 showing the applicator in the tilt position.
Figure 5:
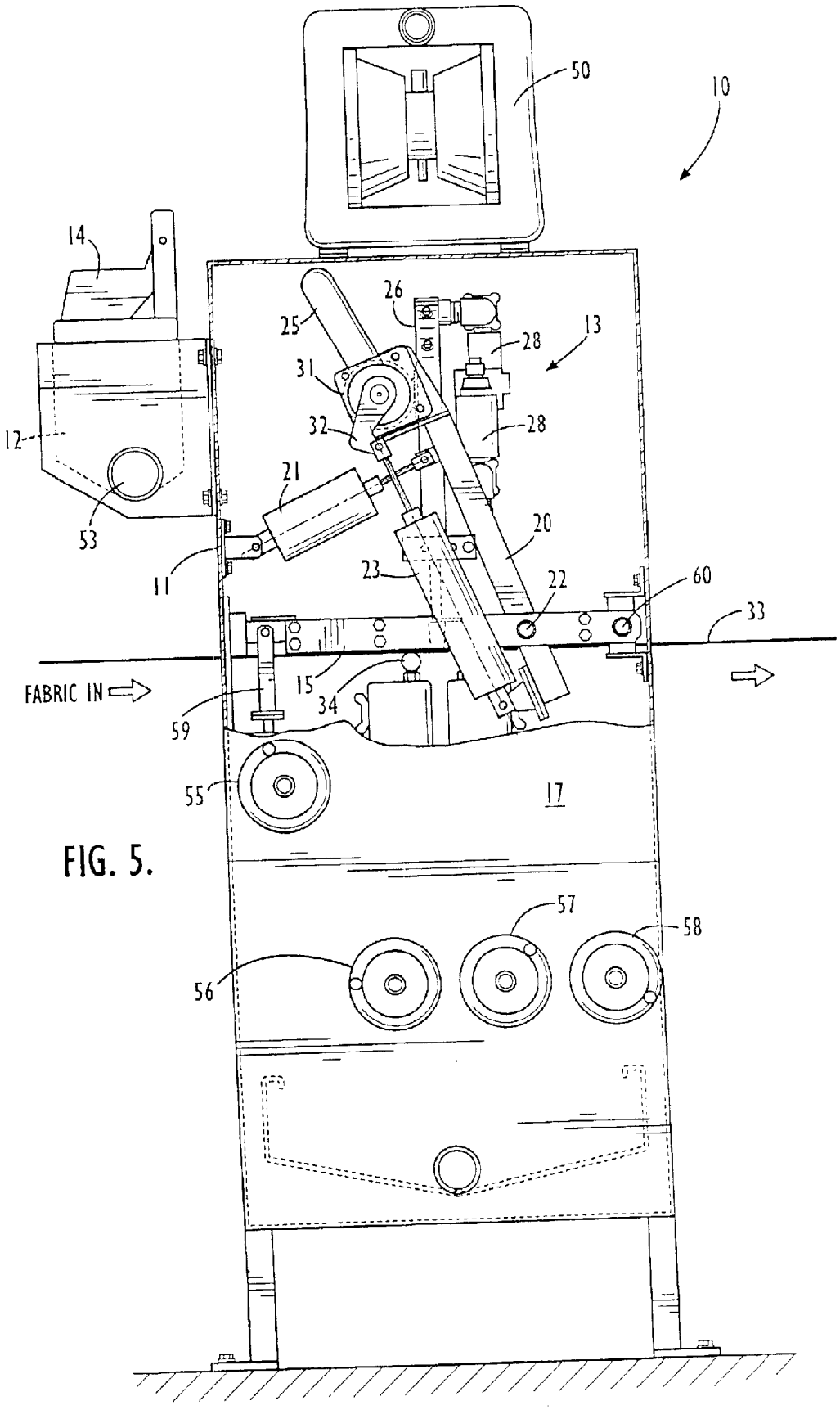
FIG. 5 is a side elevational view of the coater with the side protective plate partially cut away to show the applicator in the operating position.

A suitable arrangement for operably connecting the first piston-cylinder mechanisms 23 to the applicator is shown in FIGS. 4 and 5. The applicator 13 is mounted on a pivot shaft 24 which extends between and is journaled in the support arms 20. FIG. 4 illustrates an applicator having a parabolic distribution chamber 26, an applicator valve assembly 40, inlet valves 28, and an open slot 27 extending transversely across the traveling substrate and corresponding to the width of substrate onto which application of coating material is desired. It should be understood, however, that the present invention is not limited to applicators having parabolic-shaped distribution chambers and indeed a wide variety of various foam applicators having transversely extending open slots may be used with the present invention. One or more inlet valves 28 may also be used with the applicator to control delivery of foamed material or other fluids to the applicator.

As shown most clearly in FIGS. 3 and 5, one end of the first piston-cylinder mechanisms 23 is operably connected to the pivot shaft 24 using L-shaped levers 32. The pivot shaft 24 is journaled between a pair of support arms 20 using journal bearing mechanisms 31 such that the pivot shaft is free to rotate within the journal bearing mechanisms 31. The L-shaped levers 32 are rigidly attached to the ends of the pivot shaft 24 and one end of the first piston-cylinder mechanisms 23 is pivotally connected to the levers. In this way, extension of the first piston-cylinder mechanisms causes rotation of the pivot shaft, which in turn causes the attached applicator to pivot.

A significant problem encountered when coating textile substrates, and especially when coating textile substrates with a viscous coating material that is film-forming under atmospheric pressure, is reconciling the desirability of applying a metered amount of coating material to the back of a substrate traveling face-down with the necessity of cleaning or flushing the coating material from the coater after application is complete. For example, it is often desirable to apply latex coating material to the back of a textile substrate traveling face-down in order to increase the structural integrity of the substrate fabric. Under these conditions, it is desirable for the applicator and more particularly for the open slot to face downward. This downward applicator orientation and the film-forming property of latex material, however, create the problem of how to clean the latex material from the applicator when the coating process is completed. Since the applicator is facing downward, it would be difficult to run a large volume of flushing fluid through the applicator without also spraying the flushing fluid on other parts of the coater apparatus and onto the floor of the processing facility. Additionally, if the flushing fluid does not remove all of the foamed material from the applicator, then there is a danger that the latex material will form a film on the inside of the applicator walls, thus hindering the applicator performance during future coating operations.

The coater of the present invention solves these problems by providing a foam applicator that is movable between an operating position and a flush position. In the operating, the open slot of the applicator is adjacent the traveling substrate. In the flush position, the open slot is adjacent the flush pan such that flushing fluid may be supplied to the applicator and collected in the flush pan. It is particularly advantageous for the coater to be designed such that the open slot of the applicator is facing generally upward when the applicator is in the flush position because an applicator pointing generally upward can be left substantially full of flushing fluid after flow of the flushing fluid through the applicator stops. Leaving the applicator substantially full of flushing fluid is advantageous because the liquid remaining in the applicator keeps the applicator walls wet and thereby prevents film formation on the applicator walls in the event that film-forming coating materials such as latexes are incompletely flushed out of the applicator. It will also be understood by those in the art that an applicator facing generally above horizontal, even if not facing substantially upward, will also hold flushing fluid after the flow of flushing fluid through the applicator stops. A coater designed such that the open slot of the applicator is facing generally above horizontal when the applicator is in the flush position is therefore also within the scope of the present invention.

Figure 11:
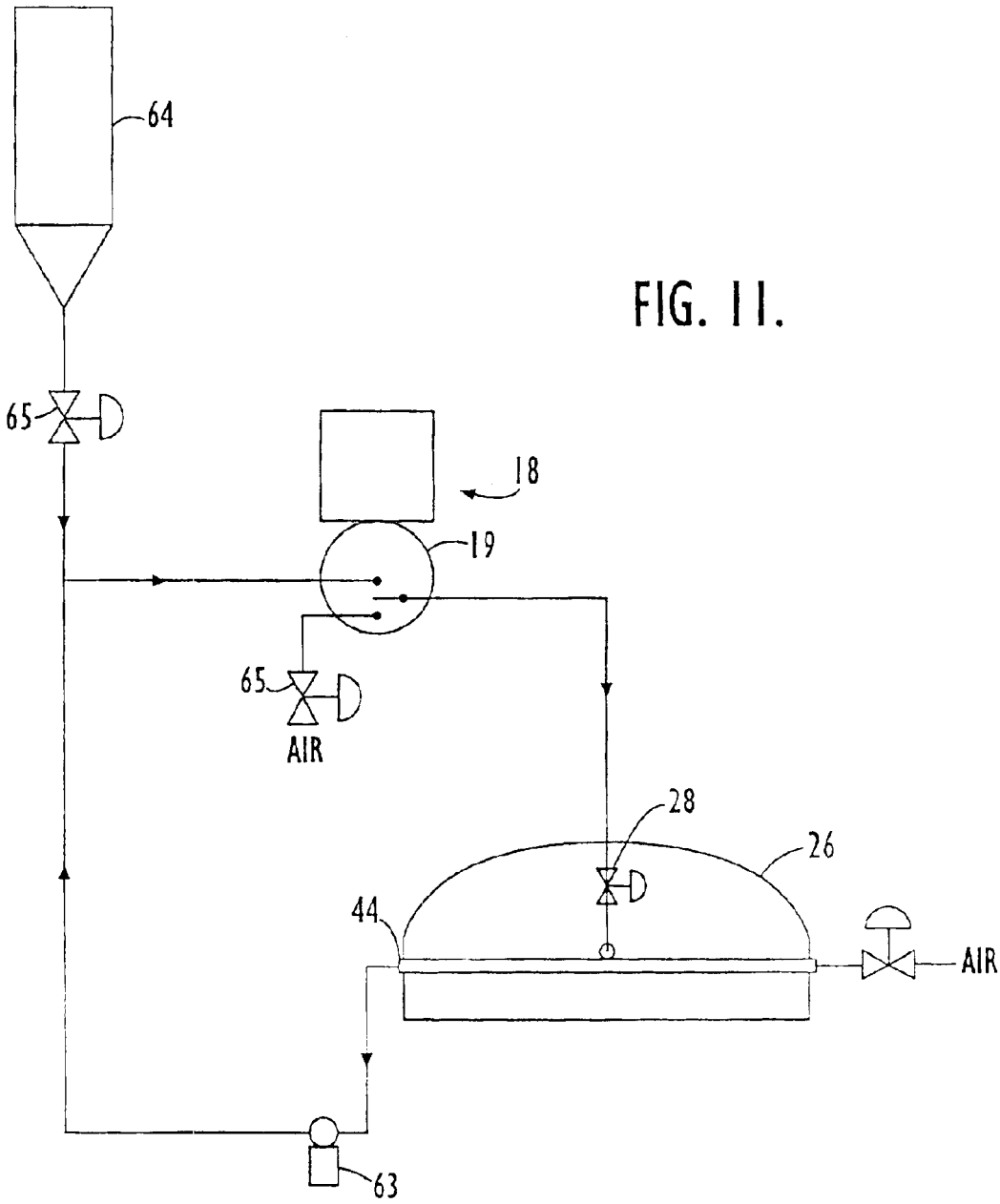
FIG. 11 is a schematic view illustrating a foam recirculation flow path.

FIGS. 5–8 illustrate the sequential interaction of the first and second piston-cylinder mechanisms as the applicator of the present invention moves from the operating position to the flush position. FIG. 5 illustrates the coater in the operating position. In this position, the applicator 13 contacts the traveling textile substrate 33 as the substrate travels in a linear run over the spaced support elements 34. Foamed coating material produced by a conventional foam generator 18 (see FIG. 11) is introduced to the applicator by a inlet valve 28. Use of a parabolic distribution chamber 26 insures that foamed material is uniformly supplied across the open slot 27 and onto the adjacent traveling textile substrate 33.

In the event that the traveling substrate lacks the structural characteristics to allow an even application between the two spaced rods 34 while contacting the applicator open slot, a supporting sheet may be positioned over the spaced support elements 34 to give additional support to the traveling substrate. In the event that such a supporting sheet is utilized, then the traveling substrate would be positioned between the supporting sheet (not shown) and the applicator when the applicator is in the operating position. The supporting sheet may be made of any suitable material such as plastic, metallic film, or the like and may be changed periodically when worn as desired. A suitable support sheet arrangement including a protective sheet supply roll, takeup roll, and releasable clamp brackets that may be used to position the support sheet onto the coater of the present invention is disclosed in pending U.S. patent application Ser. No. 09/175,651, filed by Aurich on Oct. 20, 1998, the disclosure of which is hereby incorporated by reference into the present application.

A particular advantage of the present invention is the ability to uniformly apply foamed coating material to a textile substrate traveling in a linear run, regardless of the viscosity of the foamed coating material and regardless of the structure of the textile substrate. This capability is achievable in the present invention by controlling the pressure at which the foamed coating material is generated by the foam generator and by controlling the blow ratio. As used herein, the term "blow ratio" refers to the ratio of air volume to the liquid coating material volume at which the coating material has been foamed.

The output pressure of the foam generator is adjusted to insure that even foamed materials having a high viscosity, such as latexes, polyurethanes and acrylics, are made to travel from the foam generator 18 through the applicator 13 and onto the traveling substrate 33 with sufficient pressure to force the foamed material at least partially into the interstices of the traveling substrate, regardless of the structure of the substrate. Foam generator output pressures between 5 and 90 PSI have been effectively used in the present invention. The blow ratio of foamed coating material is adjusted for a given traveling substrate speed to insure that the desired amount of foamed material is deposited on the traveling substrate and to regulate the depth of coating material penetration. Blow ratios from about ½:1 to about 110:1 have been effectively used in the present invention. The parabolic distribution chamber 26 insures that the foamed coating material is uniformly distributed to the traveling substrate and the fact that the coating material penetrates the interstices of the traveling substrate while still a foam facilitates uniform coating of the textile fibers in the substrate.

The present invention, therefore, does not rely upon capillary action or absorption in order to insure uniform coating of the fibers in the textile substrate. Nor is there a need in the present invention for such procedures as removing excess coating material with a doctor blade, opening the interstices of the substrate by insuring a wrap angle of substrate travel around an applicator open slot, or directing the traveling substrate through nip mechanisms or other apparatuses designed to remove excess coating material or moisture.

Figure 6:
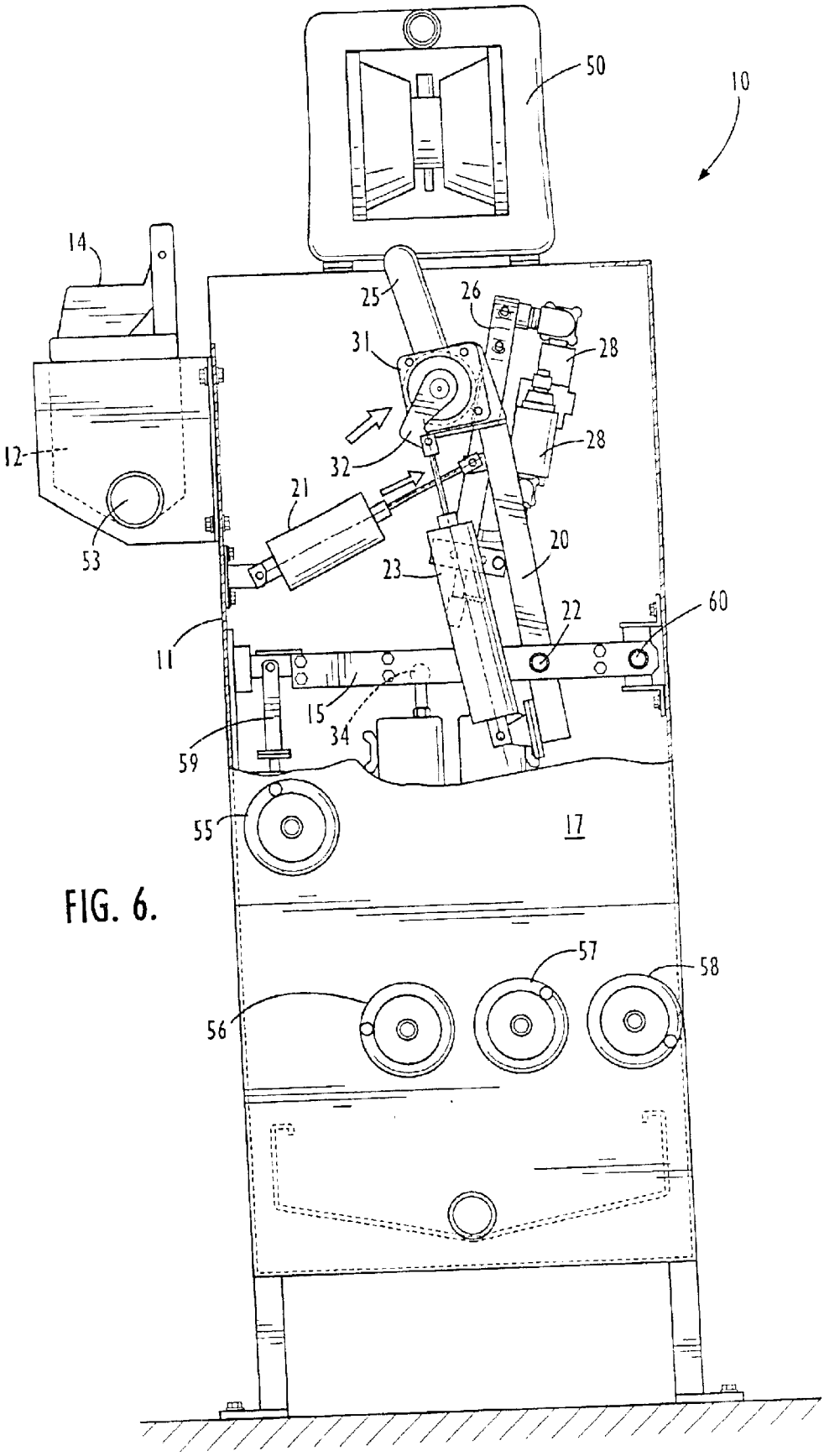
FIG. 6 is a side elevational view similar to FIG. 5 with the applicator in the tilt position.

FIG. 6 illustrates the initial step in moving the applicator from the operating position to the flush position, which is accomplished without interference between the applicator and the flush pan 12 during such movement. Specifically, the second piston-cylinder mechanisms 21 are first extended to pivot the pair of support arms 20 about their respective support arm pivot points 22. This support arm pivoting motion moves the applicator away from the textile substrate if the substrate is still in the coater when this movement is performed. Because the pivoting motion of the support arms 20 acts to tilt the applicator, the position wherein the second piston-cylinder mechanisms are extended can be referred to as the "tilt position."

Figure 7:
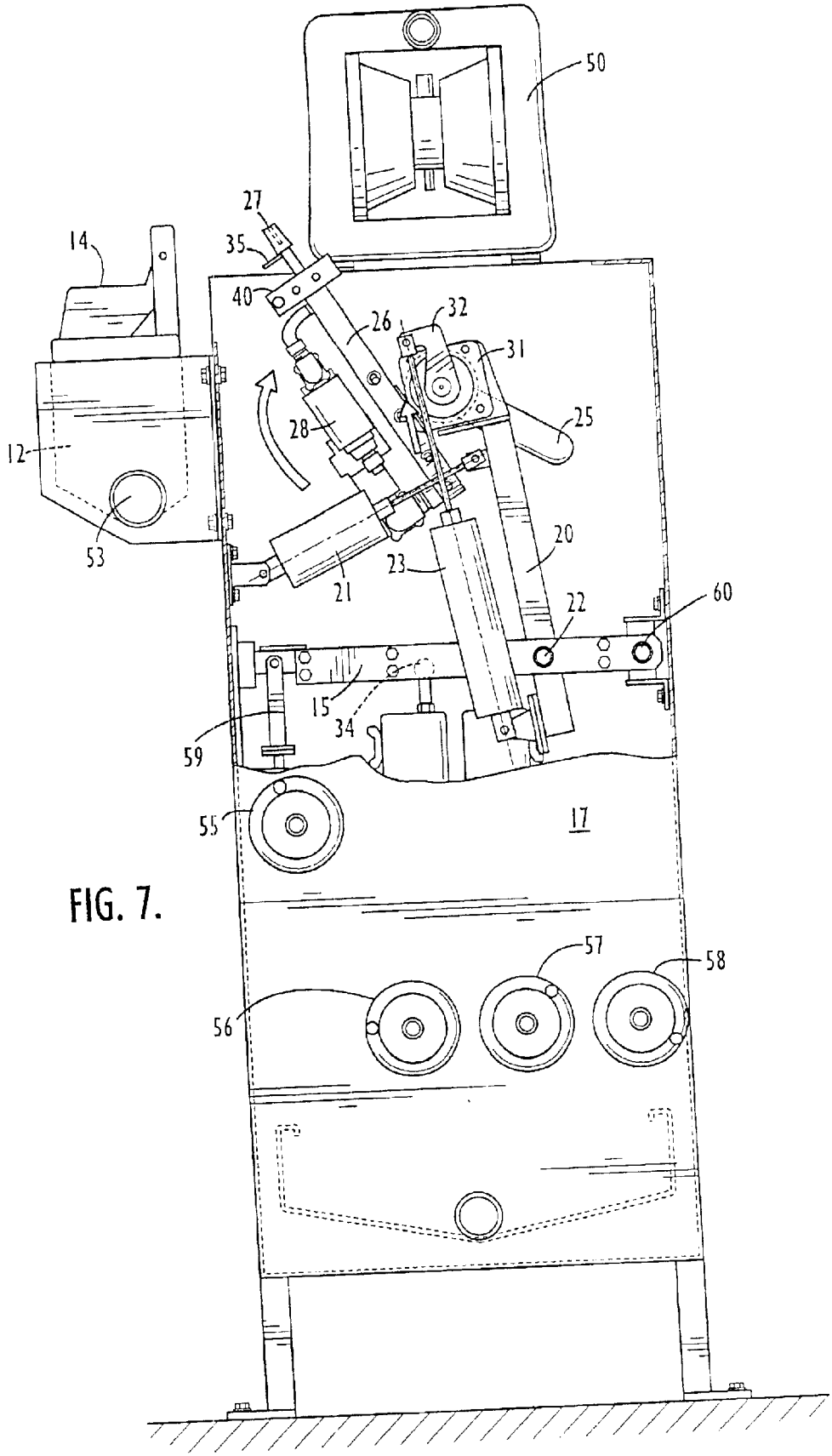
FIG. 7 is a side elevational view similar to FIG. 5 with the applicator in the swing position.

With the second piston-cylinder mechanisms extended, the first piston-cylinder mechanisms 23 are extended to rotate the levers 32 to pivot the shaft to which the applicator is attached, thereby pivoting the applicator in the direction of the flush pan 12 to a predetermined intermediate position. As illustrated in FIG. 7, such rotation should be sufficient to insure that the open slot 27 is above the level of the flush pan 12. Because rotation of the pivot shaft "swings" the applicator away from the substrate, the intermediate position illustrated in FIG. 7 may be referred to as "the swing position."

Figure 8:
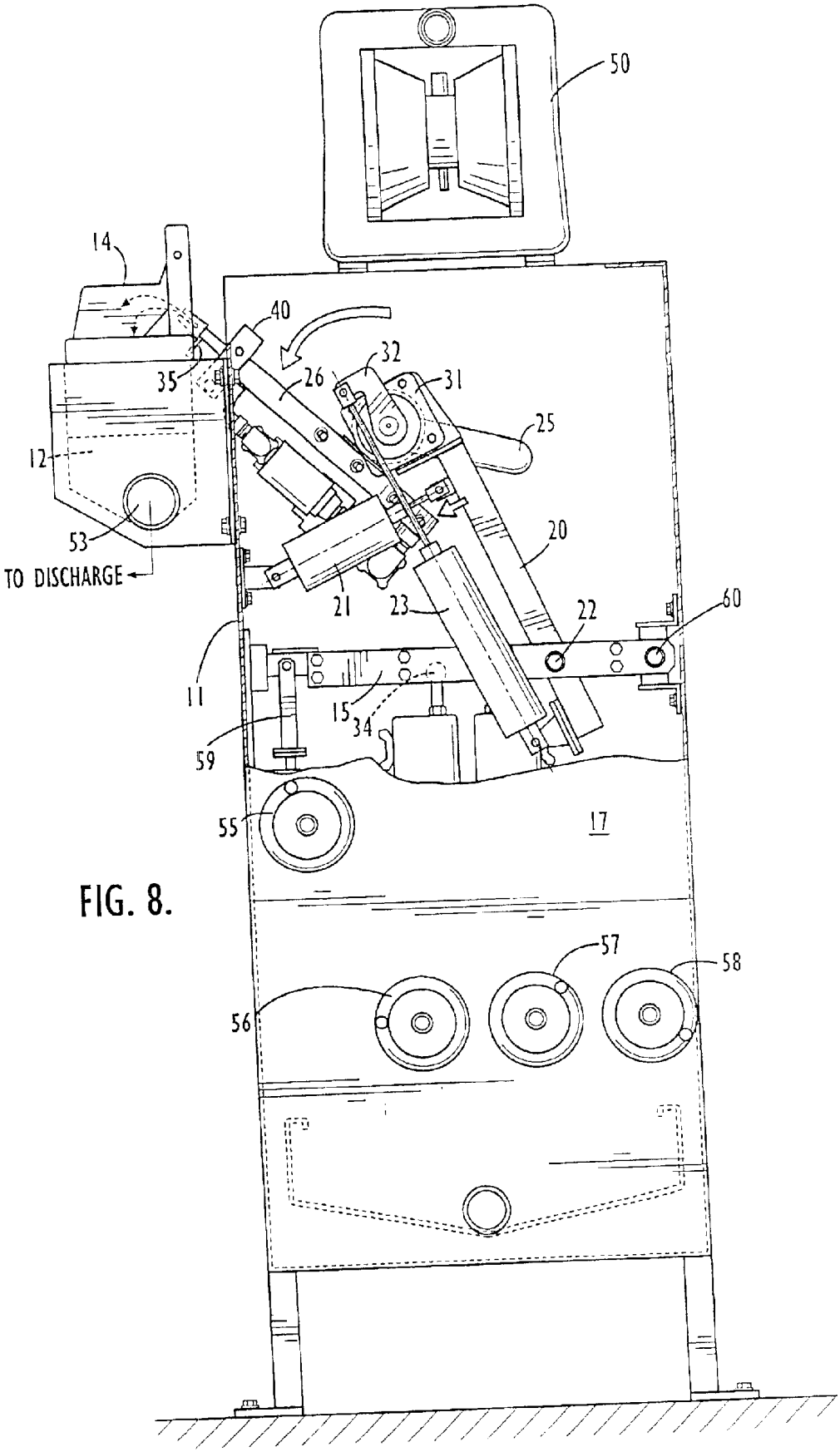
FIG. 8 is a side elevational view similar to FIG. 5 with the applicator in the flush position.

From the intermediate or swing position above the level of the flush pan, the applicator can then be moved into a flush position in which the open slot is adjacent the flush pan 12 by retraction of the first piston-cylinder mechanisms, as illustrated in FIG. 8. This retraction pivots the support arms 20 back toward the flush pan and thereby moves the applicator such that the open slot is adjacent the flush pan. In this position, which may be called the "flush position," a splash plate 35 on the applicator prevents flushing fluid that flows out of the open slot from also flowing down onto the rest of the coater. Advantageously, a hinged cover 14 may be provided on the flush pan 12. Once in the flush position, foamed coating material may be flushed from the applicator and collected in the flush pan. Suitable piping or tubing material may be connected to the flush pan discharge outlet 56 in order to provide a passage for foamed material or flushing fluid out of the flush pan.

When flushing has been completed, the applicator of the present invention may be returned to the operating position by reversing the sequence of piston-cylinder mechanism steps discussed above. Extension of the second piston-cylinder mechanisms 21 pivots the support arms 20 away from the flush pan, thereby moving the applicator away from the flush pan and into the swing position. Then, retraction of the first piston-cylinder mechanisms 23 causes reverse rotation of the pivot shaft, thereby returning the applicator to the tilt position. Finally, retraction of the second piston-cylinder mechanisms 21 reversibly pivots the support arms 20, thereby returning the applicator to the operating position. The pivot shaft 24 may be equipped with a counterbalance 25 to assist in smooth movement of the pivoting applicator.

The applicator of the present invention can be equipped with an applicator valve assembly 40 to control the outward flow of coating material through the open slot and to provide for a way to bypass foamed material past the open slot without application to the substrate. There are at least two instances in which it would be desirable to stop outward flow of material through the open slot. First, it is advantageous to stop such outward flow when the applicator moves from the operating position to the flush position. Second, it is advantageous to stop outward flow through the open slot during temporary stops in the traveling substrate because continuation of outward foam flow onto a stationary substrate results in waste of not only the coating material but also of that portion of the substrate to which excess coating material has been applied during the stoppage.

While it is advantageous to stop outward foam flow through the applicator when the substrate stops traveling, such a stoppage creates the potential for pressure to equalize in the foam delivery system while outward foam flow through the applicator is stopped. During operation, there is a dynamic pressure differential between the pressure acting on the foamed coating material exiting the foam generator and the pressure acting on the foamed coating material exiting the open slot onto the substrate, the pressure being greatest at the discharge of the foam generator and decreasing as the foamed material travels toward the open slot in the applicator. If flow of foamed material out of the applicator and the foam generator itself are stopped, pressure will begin to equalize in the foam distribution system. Such an equalization of pressure necessarily affects the amount and uniformity of coating material that is distributed on the substrate when coating operations recommence and foam flow is restarted from the applicator to the traveling substrate. This condition also results in waste of substrate material that is incorrectly coated and waste of coating material that is not utilized until normal pressure is restored in the foam distribution system.

Figure 9:
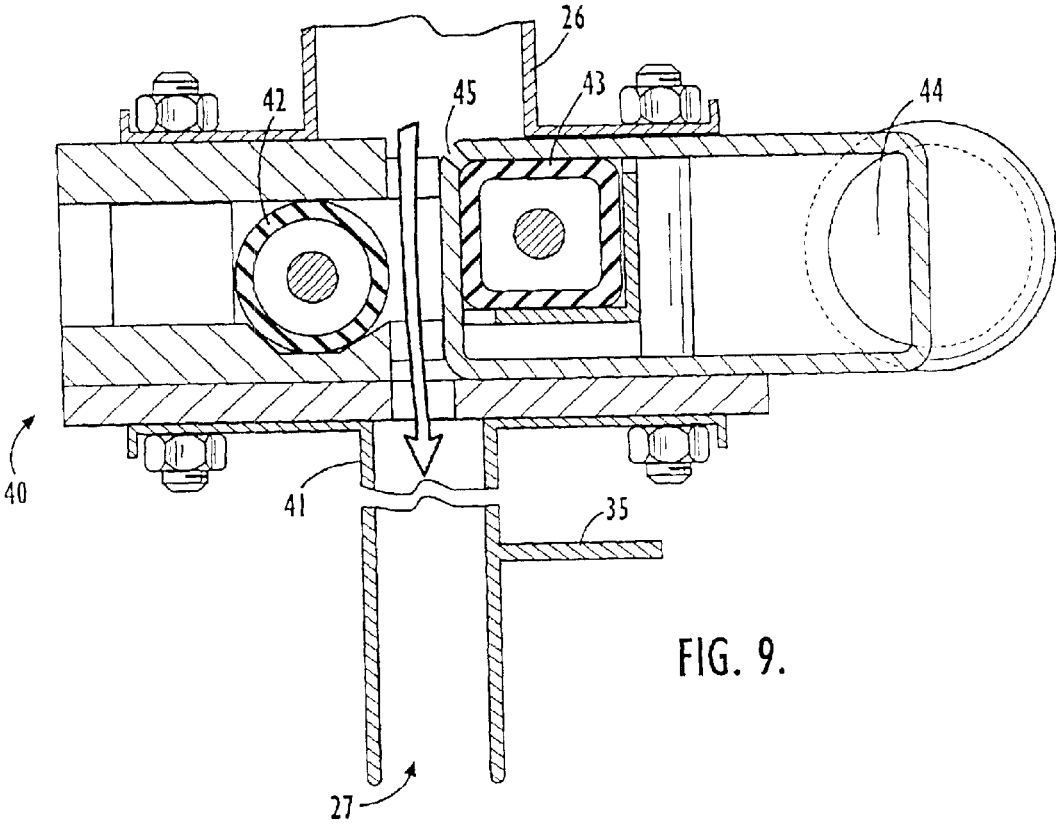
FIG. 9 is a sectional view of the applicator valve assembly taken along line 9—9 in FIG. 1 and showing the path of foam flow through the applicator during coating operation.
Figure 10:
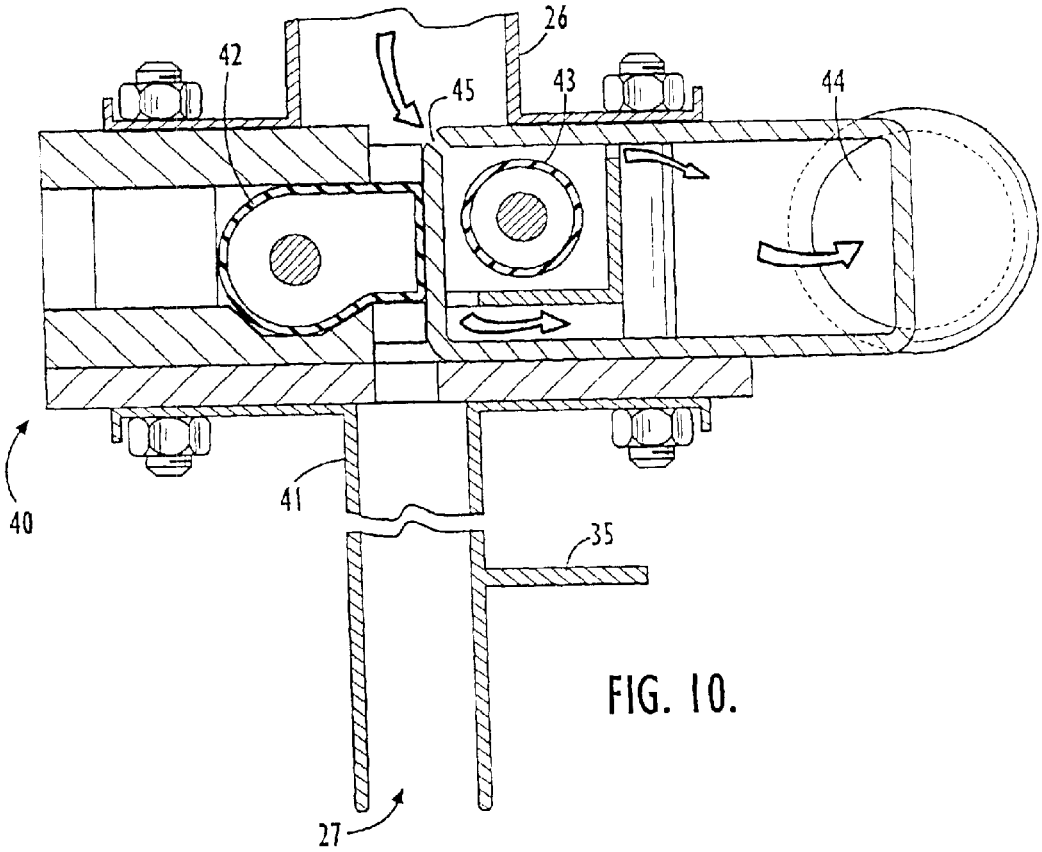
FIG. 10 is a sectional view similar to FIG. 9 showing the flow of foamed material in the bypass mode of operation.

The present invention accommodates the ability to stop outward foam flow through the open slot of the applicator while preventing the undesirable equalization of foam pressure throughout the distribution system by providing a valve assembly 40 comprising an applicator flow valve member 42, a bypass flow valve member 43, and a bypass passage 44, as illustrated in FIGS. 9 and 10. The applicator flow valve member 42 and the bypass flow valve member 43 may be inflatable bladders.

FIG. 9 illustrates the valve assembly 40 configured to allow outward flow from the parabolic distribution chamber 26 through the replaceable nozzle 41 and out of the open slot 27. In this position, the applicator flow valve member 42 is deflated so as not to obstruct the outward flow of material through the open slot and the bypass flow valve member 43 is inflated to prevent the flow of foamed material through the bypass channel 45 and out the bypass passage 44.

When it is desired to stop outward flow through the open slot 27, the applicator flow valve member 42 may be inflated to obstruct the outward flow of foamed material through the open slot 27, as illustrated in FIG. 10. But it is also sometimes desirable that foam flow continue even though the open slot is closed in order to prevent stagnation of the foamed material and the corresponding danger of pressure equalization discussed above. In this instance, the bypass flow valve member 43 may be deflated, also as illustrated in FIG. 10. When the bypass flow valve member 43 is deflated, the flow of foamed material through the applicator is diverted into the bypass channel 45 and allowed to travel through the valve assembly 40 to the bypass passage 44. Foamed material exiting the applicator through the bypass pass may be collected for disposal or for later use. In this way, proper pressurization can be maintained in the foam distribution chamber such that coating operations may be easily recommenced by deflating the applicator flow valve member 42 and inflating the bypass flow valve member 43, thereby redirecting outward foam flow through the open slot 27.

While collecting foamed material exiting the bypass passage for disposal or later reuse may be a justifiable method of maintaining proper pressurization in the distribution chamber for momentary interruptions of the application process, such collection is also disadvantageous because it necessitates proper storage or disposal of the accumulated foamed material. The present invention overcomes this disadvantage by providing a foam recirculation flow path between the applicator and the foam generator 18 and by using foam recirculation to maintain proper pressurization within the foam delivery system during stoppages. As illustrated in FIG. 1, foamed material exiting the bypass passage 44 of the parabolic distribution chamber 26 is returned to the inlet of the roamer head 19 by a foam recirculation pump 63, which is preferably a positive displacement type pump. During such foam recirculation, isolation valves 65 are used to stop the supply of air and fresh coating material from the stock tank 64 to the foam generator such that no new material is foamed during the recirculation nor is additional air introduced into the foam delivery system. In this way, foam recirculation is established during system stoppages to maintain the dynamic pressure gradient of the recirculating foam and accordingly no foamed material waste is generated.

The present invention also includes several methods of flushing foamed material from a coater having a flush pan. In one such method, flow of foamed coating material through the applicator is first stopped. Then, the applicator is moved from its operating position to a position adjacent the flush pan. Fluid communication between a supply of flushing fluid and the applicator is then established. Often, water or a combination of water with various flushing chemicals known in the art is used as the flushing fluid. For example, a typical flushing fluid may be composed of water and surfactant. Once fluid communication has been established between the applicator and the supply of flushing fluid, and the applicator is in a position adjacent a flush pan, flushing fluid is then made to flow through the applicator and into the flush pan. Utilizing this method of flushing foamed material from a coater, it is possible to flush the foamed coating material from an applicator that is usually operated facing downward without getting flushing fluids on a substrate in the coater and without creating a large spillage of flushing fluid on the floor of the textile processing facility.

The coater of the present invention may advantageously be used to establish a recirculating flushing flow path by connecting the flush pump effluent 51 to the applicator through an inlet valve 28 and by connecting the flush pump influent 52 to the flush pan discharge outlet 53. Flushing fluid may then be provided to the flushing pan. When the applicator is in the flush position and the flush pump 50 is activated, flushing fluid is drawn from the flush pan through the flush pump and forced through the applicator, where it exits through the open slot 27 and goes back into the flush pan 12. Advantageously, because the open slot is facing generally upward or at least above horizontal when the applicator is in the flush position, the applicator is left substantially full of flushing fluid when the flush pump 50 is turned off, as previously discussed. Leaving the applicator substantially full of flushing fluid effectively prevents the buildup of film on the inside of the applicator walls.

It has been discovered, however, that flushing a viscous foamed coating material from a coater or applicator using only a flushing fluid sometimes fails to completely remove the foamed coating material from the applicator. This is possibly because the viscosity of the foamed coating material results in adhesion among this material and between the coating material and the applicator walls. When flushing fluid is forced into the applicator, the fluid often channels through the viscous foamed coating material instead of completely removing the coating material from the applicator.

To prevent the incomplete flushing of foamed coating material from an applicator, the present invention also includes a method of flushing foamed material from a foam applicator using both a flushing foam and a flushing fluid. More particularly, after stopping flow of foamed coating material through the applicator, a separate flushing foam is then made to flow through the applicator. A particularly advantageous flushing foam is comprised of water and a foamed surfactant. It is thought that the density of the flushing foam being similar to the density of the coating foam helps remove the foamed coating material from the applicator. The flushing foam may be supplied by the same foam generator as is used to generate the foamed coating material or from another foam source. After a once-through flushing foam flow, flushing fluid is run through the applicator as discussed above. Advantageously, the flushing fluid may be circulated through the applicator at a higher flow rate than the flushing foam flow rate through the applicator.

It will readily be understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise to exclude any such other embodiments, adaptations, variations, modifications or equivalent arrangements; the present invention being limited only by the claims appended hereto and the equivalents thereof. Although specific terms are employed herein, they are used in a generic and descriptive sense only and not for the purpose of limitation.

That which is claimed is:

1. A method of flushing foamed material from a coater having a flush pan and a foam applicator having an open slot for applying foamed material to a substrate when the applicator is in an operating position, comprising the steps of:

stopping flow of foamed material through the applicator;

moving the applicator from its operating position to a position adjacent the flush pan with the open slot facing generally upward;

establishing fluid communication between a supply of flushing fluid and the applicator; and causing flushing fluid to flow from the supply of flushing fluid through the applicator and into the flush pan.

2. A method of flushing foamed material from a coater as defined in claim 1 wherein the supply of flushing fluid is provided from the flush pan such that flushing fluid is recycled from the flush pan, through the applicator, and back into the flush pan when the flow of flushing fluid is commenced.

3. A method of flushing foamed material from a coater as defined in claim 1, comprising the additional step of stopping the flow of flushing fluid through the applicator while the applicator is facing generally upward, leaving the applicator substantially full of flushing fluid.

4. A method of flushing foamed material from the open slot of a foam applicator used in an operating position to apply foamed material to a substrate, comprising the steps of:

stopping the flow of foamed material through the applicator;

commencing flow of a flushing foam through the applicator with the open slot facing generally upward;

stopping flow of flushing foam through the applicator; and commencing flow of a flushing fluid through the application with the open slot facing generally upward.

5. A method of flushing foamed material from a foam applicator as defined in claim 4, wherein said step of commencing flow of a flushing foam is performed with a flushing foam comprising water and a foamed surfactant.

6. A method of flushing foamed material from a foam applicator as defined in claim 4, further comprising the step of moving the applicator from its operating position to a position adjacent a flush pan after stopping flow of foamed material through the applicator and before commencing flow of a flushing through the applicator.

7. A method of flushing foamed material from a foam applicator as defined in claim 6, comprising the additional step of recirculating the flushing fluid from the flush pan, through the applicator and back into the flush pan when flow of the flushing fluid is commenced.

8. A method of flushing foamed material from a foam applicator as defined in claim 7, comprising the additional step of stopping the flow of flushing fluid through the applicator while the applicator slot is facing generally upward, leaving the applicator substantially full of flushing fluid.

* * * * *